United States Patent [19]

Gospodar

[11] 3,981,284

[45] Sept. 21, 1976

[54] CARBURETOR

[75] Inventor: Reinhard Gospodar, Wolfsburg, Germany

[73] Assignee: Volkswagenwerk Aktiengesellschaft, Wolfsburg, Germany

[22] Filed: Nov. 15, 1974

[21] Appl. No.: 524,256

[30] Foreign Application Priority Data

Nov. 17, 1973 Germany ..... 2357465

[52] U.S. Cl. ..... 123/119 A; 123/119 R; 123/119 E; 123/140 MP; 261/50 A; 261/69 R; 261/DIG. 74

[51] Int. Cl.[2] ..... F02M 9/06

[58] Field of Search ..... 261/50 A, DIG. 74, 69 R; 123/119 R, 140 MC, 140 MP, 32 EA

[56] References Cited

UNITED STATES PATENTS

| | | | |
|---|---|---|---|
| 2,493,587 | 1/1950 | Lee | 123/119 |
| 3,342,463 | 9/1967 | Date et al. | 123/103 R X |
| 3,528,787 | 9/1970 | Hallberg | 123/119 R X |
| 3,841,283 | 10/1974 | Wood | 123/119 R |
| 3,855,974 | 12/1974 | Mayer | 123/119 R X |
| 3,884,195 | 5/1975 | Murtin et al. | 123/119 R X |

*Primary Examiner*—Charles J. Myhre
*Assistant Examiner*—Tony M. Argenbright
*Attorney, Agent, or Firm*—Brumbaugh, Graves, Donohue & Raymond

[57] ABSTRACT

A carburetor for an internal combustion engine has a throttle valve in an intake channel for the passage of air and fuel to the engine. A fuel discharge nozzle and a piston valve in the intake channel upstream of the throttle valve cooperatively regulate the volume of fuel and air mixed in a mixture region of the intake channel between the piston valve and the throttle valve. Drive means position the piston valve in the intake channel relative to the nozzle in response to distinct control means dependent upon operating conditions of the internal combustion engine to regulate the mixture in dependence upon the operating conditions of the engine.

10 Claims, 4 Drawing Figures

CARBURETOR

BACKGROUND OF THE INVENTION

The present invention relates to a carburetor for an internal combustion engine having a piston valve in an intake channel which cooperates with a fuel discharge nozzle to regulate the mixture of air and fuel at a mixture region in the intake channel and, more particularly, to such a carburetor in which drive means position the piston valve in the intake channel in response to distinct control means the operation of which is dependent upon the operating conditions of the internal combustion engine.

Carburetors for internal combustion engines mix fuel with air to provide a desired mixture of air and fuel for operating the engine. One type of carburetor has a throttle valve in an intake channel for regulating the volume of the air-fuel mixture provided to the engine to control the operation of the engine. A fuel discharge nozzle is positioned on the intake channel, upstream of the throttle valve, and opposite a piston valve. The piston valve movably extends into the intake channel to vary the cross section of the channel. A conical needle valve extends from the piston valve into a fuel exit aperture of the nozzle to also vary the cross section of the aperture through which fuel can flow into the intake channel in response to the position of the piston valve in the intake channel.

When the throttle valve opens or closes to change the volume of the air-fuel mixture flowing to the engine, the piston valve moves out of or into the intake channel to control the speed with which the corresponding volume of air flows past the piston valve and fuel discharge nozzle. The air passing the exit aperture of the nozzle creates a negative pressure or aspirator-like suction at the aperture which draws fuel through the aperture into the intake channel for mixing with the air in a mixture region of the intake channel between the piston valve and nozzle and the throttle valve. The suction is a function of the speed of the air passing the fuel exit aperture of the nozzle and greater suctions draw the fuel through the aperture at greater rates. The rate of fuel flow through the aperture and the cross section of the aperture through which the fuel flows determine the volume of fuel drawn into the intake channel. The ratio of the air volume entering the mixture region past the piston valve and the fuel volume drawn from the nozzle by the passing of this air determines the richness of the air-fuel mixture.

The desired richness of the air-fuel mixture is determined by the operation of the internal combustion engine. The air-fuel richness is substantially constant for an engine; however, the richness is often desirably increased for more open positions of the throttle valve which correspond to higher speed or greater power operation of the engine. Moreover, it is often desirable to increase the richness of the air-fuel mixture during periods of engine acceleration or increasing power which correspond to opening movement of the throttle valve.

Therefore, a carburetor of the type described operates by moving the piston valve in the intake channel to vary its cross section and provide a substantially constant speed to the volume of air passing the nozzle and a corresponding change in the cross section of a fuel exit aperture through which fuel flows from the nozzle into the intake channel by moving the needle valve in the fuel exit aperture with the movemement of the piston valve to maintain the desired richness of the air-fuel mixture. To provide a richer mixture for more open positions of the throttle valve, the cross section of the intake channel is limited by the piston valve to increase the speed of the air flowing past the piston vlave and the nozzle which thereby increases the suction at the exit aperture of the nozzle to draw a higher volume of fuel from the aperture relative to the volume of the air passing the aperture. Similarly, when it is desired to increase the richness of the mixture during opening movement of the throttle valve for acceleration of the engine, the speed with which the piston valve moves to increase the cross section of the intake channel is damped relative to the speed with which the throttle valve is opening to transiently increase the speed of the air passing the piston valve and nozzle and thereby transiently increase the richness of the air-fuel mixture.

Known devices for moving the piston valve in the intake channel in response to the operating conditions of the internal combustion engine determined by the position of the throttle valve in the intake channel are mechanically combined with means detecting the operating conditions of the engine in response to which the piston valve is to be moved. These combined piston valve moving means and engine condition responsive means operate from pressure differentials in the intake channel upstream and downstream of the piston valve which are produced by the relative positions of the piston valve and throttle valve. Such mechanical devices have sufficiently high operating friction relative to these small, pneumatic actuating forces to interfere with proper movement of the piston valve. The operating friction may additionally introduce hysteresis into the operation of the piston valve to further impede its proper operation. Moreover, such known carburetors can only be operated with the piston valve in an essentially vertical position with the air intake channel into which the piston valve extends then being essentially horizontal. Such transverse draft carburetors may not be desired.

SUMMARY OF THE INVENTION

It is therefore an object of the invention to provide a carburetor of the indicated type but which avoids the aforementioned difficulties in the operation of the piston valve and which can be operated with a vertical draft.

The above object, as well as other objects which will become apparent from the description which follows, are achieved, according to the present invention, by providing drive means for positioning a piston valve in an intake channel of a carburetor in response to distinct control means operative in dependence upon operating conditions of an internal combustion engine on which the carburetor is used. The drive means, being distinct from the control means which respond to the operating conditions of the engine, are not limited by the power available from the operating conditions of the engine.

The piston valve is upstream of a throttle valve in the intake channel and is arranged to move linearly across the intake channel in a direction substantially transverse to a longitudinal axis of the intake channel to thereby vary the cross sectional area of the intake channel at the piston valve. An exit aperture of a nozzle for discharging fuel into the intake channel receives a tapered nozzle needle which projects into the exit aperture from the piston valve, the exit aperture defining a point of air-fuel mixture at a mixture region of the intake channel which extends toward the throttle valve. The taper of the nozzle needle extends outwardly from an end of the needle remote from the piston valve toward the end of the needle at the piston valve to vary the cross sectional area of the exit aperture through which fuel can flow into the intake channel.

The drive means are connected to the piston valve for moving the piston valve and nozzle needle in the intake channel. In a preferred embodiment, the drive means comprise a servo motor and feedback means cooperative with the control means for determining when the drive means have moved the piston valve to a position determined by the control means. The control means of the preferred embodiment comprise means responsive to the pressure difference between the total in the intake channel pressure and the static pressure in the mixture region which is dependent upon the operating conditions of the engine as determined by the relative position of the throttle valve in the intake channel.

When the throttle valve opens the air intake channel, the static pressure in the adjacent mixture region of the intake channel falls relative to the total pressure upstream of the piston valve. The control means responds to this operating condition to cause the drive means to move the piston valve outwardly of the intake channel to increase the cross sectional area of the intake channel. This movement of the piston valve moves the nozzle needle outward of the fuel exit aperture to also increase the cross sectional area of the exit aperture through which fuel can flow to provide the desired mixture of fuel to air. When the throttle valve closes the intake channel, the drive means move the piston valve and nozzle needle inward of the intake channel to again maintain the desired mixture. In the preferred embodiment, the speed with which the drive means move the piston valve in response to changes in the operating conditions of the engine is such as to transiently increase the richness of the fuel-to-air mixture.

DESCRIPTIONS OF THE DRAWINGS

DESCRIPTION OF THE PREFERRED EMBODIMENTS

Figure 1:
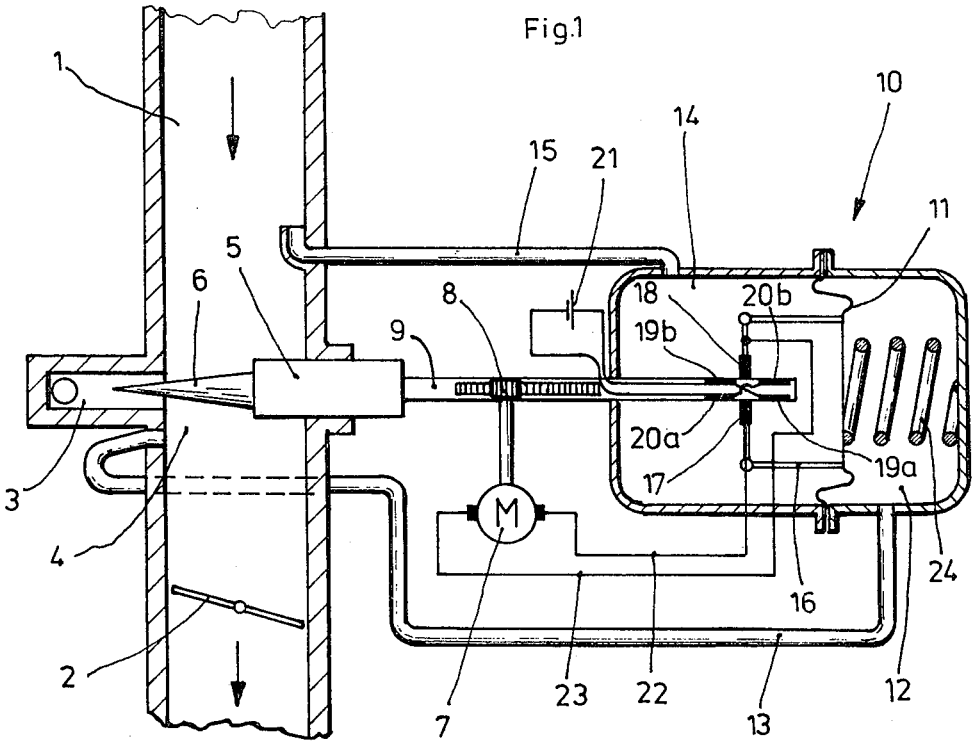
FIG. 1 is a partly sectional view of a preferred embodiment of a carburetor in which feedback means directly link drive means to control means.

The preferred embodiments of the present invention will now be described in connection with the drawings. Each of the embodiments shown in the drawings is a down draft carburetor for an internal combustion engine (not shown).

One Preferred Embodiment

The carburetor shown in FIG. 1 has a generally vertical intake channel 1 for providing air in the direction indicated by the arrows from a filter (not shown) to the engine. A throttle valve 2 is pivoted in the intake channel for variably opening or closing the intake channel in response to demand for varying operation of the engine. A nozzle 3 has an exit aperture communicating with one side of the channel upstream of the throttle valve. A piston valve 5 is arranged on a side of the intake channel opposite the nozzle for linear movement across the intake channel and toward and away from the nozzle for varying the cross sectional area of the intake channel through which the air can flow. A tapered nozzle needle 6 extends from the piston valve into the exit aperture of the nozzle for forming cooperatively with the exit aperture a generally annular passage through the aperture for discharging the fuel from the nozzle into the intake channel, the taper of the nozzle needle varying the cross sectional area of the passage as the piston valve moves with the nozzle needle toward or away from the nozzle.

An electrically operated servo motor 7 reversably drives a pinion 8 engaged with a rack on a rod 9 extending from the piston valve outside of the intake channel for moving the piston valve in the intake channel. Control means at 10 are electrically connected to the servo motor by leads 22, 23 for controlling the servo motor in dependence upon operating conditions of the internal combusion engine. The operating conditions of the internal combustion engine from which the operation of the control means depends are the relative pressures in the intake channel upstream and downstream of the piston valve. These pressures are provided by ducts 13, 15 to pressure chambers 12, 14 on opposite sides of a flexible diaphragm 11 in the control means. Differences in the pressures in the chambers then deflect the diaphragm from the chamber of higher pressure into the chamber of lower pressure. A spring 24 extends across the pressure chamber 12 to the diaphragm 11 to bias deflection of the diaphragm from the undeflected position shown in FIG. 1.

Electrical contacts 17, 18 are each connected to the diaphragm by a bracket 16 for movement with the diaphragm and electrically connected, respectively, to the leads 22, 23 to the servo motor. The piston valve rod 9 extends from the piston valve to the contacts 17, 18 to form feedback means directly linked to the servo motor drive means. The rod carries two electrical contacts each of which is connected at one end to an opposite side of a source 21 of D.C. electric power for the servo motor and open circuited at the other end; each contacts has a first portion **19*b*, 20*a* on a left side and a second portion 19*a*, 20*b* on a right side of a contactless, intermediate portion as shown in FIG. 1, the contact portions 19*a*, 20*a* being positioned for electrical connection with the contact 17, the contact portions 19*b*, 20*b* being positioned for electrical connection with the contact 18**, and the contactless, intermediate portion being positioned for defining a neutral position with no electrical connection between the contacts.

The operation of the embodiment shown in FIG. 1 may now be described. Let it first be assumed that the throttle valve 2 has just rotated counterclockwise from a more vertical position to the position shown in FIG. 1 to change the desired operation of the engine. The throttle valve then restricts the intake channel to the engine to restrict the flow to the engine of a mixture of air and fuel from a mixture region 4 of the intake channel between the fuel discharging nozzle 3 and piston valve 5 and the throttle valve. Restricting the mixture's flow increases the pressure in the mixture region of the intake channel on one side of the piston valve relative to the pressure of the air in the intake channel on the other, upstream side of the piston valve. This increased pressure is provided through duct 13 to pressure chamber 12 while the relatively lower air pressure in the intake channel upstream of the piston valve is provided by duct 15 to pressure chamber 14. The increased pressure in the pressure chamber 12 then deflects the diaphragm 11 into the pressure chamber 14.

The deflection of the diaphragm moves the contacts 17, 18 into electrical connection with the contact portions 19*b*, 20*a*. The positive side of the electrical power source 21 is then connected from the contact 19*b* through contact 18 to lead 23 while the negative side of the source is connected from contact 20*a* through 17 to lead 22. With lead 23 positive with respect to lead 22, the motor 7 rotates the pinion 8 in a direction to drive the piston valve 5 through the rack and rod 9 toward the nozzle 3. The piston valve then restricts the cross sectional area of the intake channel through which air flows to the mixture region 4 to control the speed of the air passing the piston valve.

The speed of the air passing the piston valve at the fuel exit aperture of the nozzle controls the rate at which fuel is drawn into the intake channel. However, the movement of the piston valve 5 toward the nozzle 3 also moves the nozzle needle 6 farther into the fuel exit aperture of the nozzle to restrict the cross sectional area of the exit aperture for discharging the fuel into the intake channel. The piston valve and nozzle needle control the cross sectional areas to provide a desired ratio of the volume of fuel to the volume of air passing the piston valve in the intake channel to provide a desired richness of fuel to air in the mixture region 4.

The rod 9 which moves the piston valve also functions as feedback means for the control means by carrying the contacts with it until the contact portions 19*b*, 20*a* are out of engagement with the contacts 17, 18, the contacts 17, 18 then being positioned adjacent the contactless, intermediate portion of the other contacts. The contacts 17, 18 are thus disconnected from the source 21 to stop the motor 7.

The spring 24, in addition to the pressure in the pressure chamber 12, urges the diaphragm toward the pressure chamber 14. The force of the spring on the diaphragm then permits a lower pressure in the pressure chamber 12 to deflect the diaphragm into the pressure chamber 14 against a higher pressure in the pressure chamber 14. The actual or absolute pressure in the mixture region 4 is thus the same or lower than the pressure in the intake channel upstream of the piston valve to facilitate the direction of air and fuel flow indicated by the arrows in FIG. 1. However, the force of the spring on the diaphragm is reduced as the spring extends with the deflection of the diaphragm toward the pressure chamber 14. The amount of deflection of the diaphragm for a given pressure differential in the pressure chambers is thus less when the diaphragm is more extended into the pressure chamber 14 than when the diaphragm is less deflected. The movement of the piston valve 5 for the pressure differential is thus less as it approaches the nozzle 3 to less restrict the cross sectional area of the intake channel relative to the volume of air flowing past the piston valve under the pressure differential. The speed of the air flow is then reduced to draw less fuel from the exit aperture of the nozzle which provides a leaner fuel-to-air mixture as the piston valve approaches the nozzle than when it is farther away.

Let is now be assumed that the throttle valve 2 rotates clockwise from the position shown in FIG. 1 to a more vertical position. This rotation of the throttle valve increases the cross sectional area of the intake channel at the throttle valve through which the air-fuel mixture flows which reduces the static pressure in the mixture region 4. This reduced pressure is communicated through duct 13 to the pressure chamber 12 to cause the diaphragm 11 to deflect into the pressure chamber 12. This movement of the diaphragm moves the contacts 17, 18 into electrical connection with the contacts 19*a*, 20*b*. The cross-over of the contacts in the intermediate, contactless portion now connects the positive side of the source through the contacts to the lead 22 and the negative side, to the lead 23. With lead 22 positive with respect to lead 23, the motor 7 rotates the pinion 8 in that opposite direction from that previously described to move the piston valve 5 away from the nozzle 3. This movement of the piston valve opens the cross sectional area of the intake channel through which air flows past the piston valve. The movement of the piston valve 5 away from the nozzle 3 withdraws the tapered nozzle needle 6 from the nozzle exit aperture to also increase the cross sectional area of the aperture through which fuel is discharged.

Rod 9 again functions as feedback means to the control 10 by moving the contacts portions 19*a*, 19*b*, 20*a*, 20*b* with the piston valve 5 away from the nozzle 3. When the contacts 17, 18 are again positioned in the contactless, intermediate portion of the other contacts the motor 7 is again disconnected from the source to stop the movement of the piston valve 5.

The spring 24 more strongly resists greater deflections of the diaphragm 11 into the pressure chamber 12 than smaller deflections of the diaphragm. The corresponding movement of the piston valve 5 is then also limited as the piston valve moves away from the nozzle 3 to more restrict the intake channel and increase the air speed past the piston valve in these positions of the piston valve. The higher air speed draws more fuel from the exit aperture of the nozzle to richen the fuel-to-air mixture for engine operating conditions with more open positions of the throttle. Similarly, the speed with which the motor moves the piston valve to increase the cross sectional area of the intake channel through which air can flow is set to be sufficiently slow relative to changes in the pressure upstream and downstream of the piston valve during an acceleration operating condition of the engine to transiently increase the air speed past the piston valve for transiently richening the fuel-to-air mixture during the acceleration.

Other Preferred Embodiments

Figure 2:
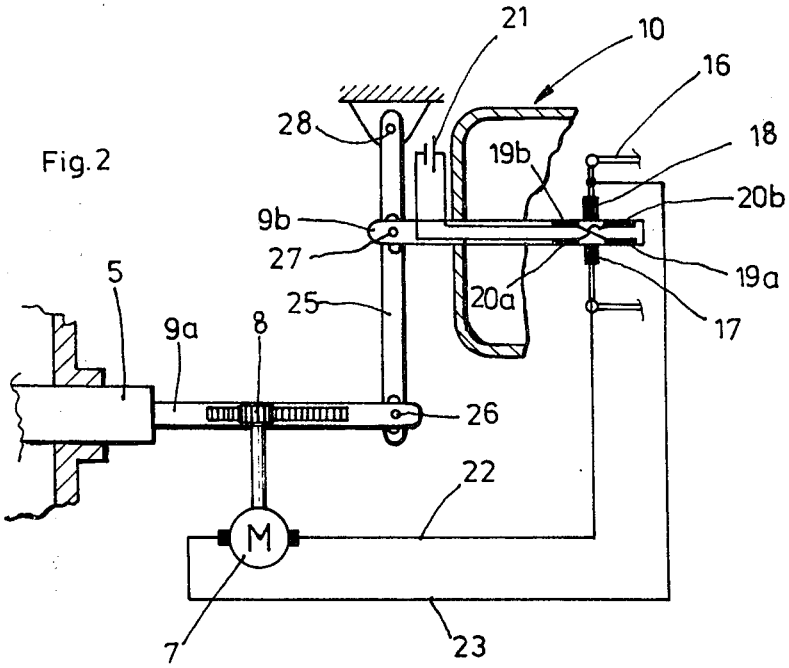
FIG. 2 is a partial view, partly in section, of another preferred embodiment of a carburetor in which feedback means indirectly link drive means to control means.

The embodiment partly shown in FIG. 2 has parts correspondingly identified with those of the embodiment shown in FIG. 1 except that the rod 9*a* is now shown to be interrupted between the pinion 8 and the contacts 17, 18 by an indirect feedback linkage. The feedback linkage comprises a rod 25 pivotably connected at one end 26 to the rod 9*a* and at the other end 28 to a frame. Another rod 9*b* is pivotably connected intermediate ends of the rod 25 and carries the contacts 19*a*, 19*b*, 20*a*, 20*b* in the control means 10. A smaller movement of the diaphragm and connected contacts 17, 18 then corresponds to a larger movement of the piston valve 5 so that the deflection of the diaphragm necessary to effect a desired movement of the piston valve is reduced. Flexure wear of the diaphragm is thus reduced relative to the diaphragm shown in FIG. 1.

Figure 3:
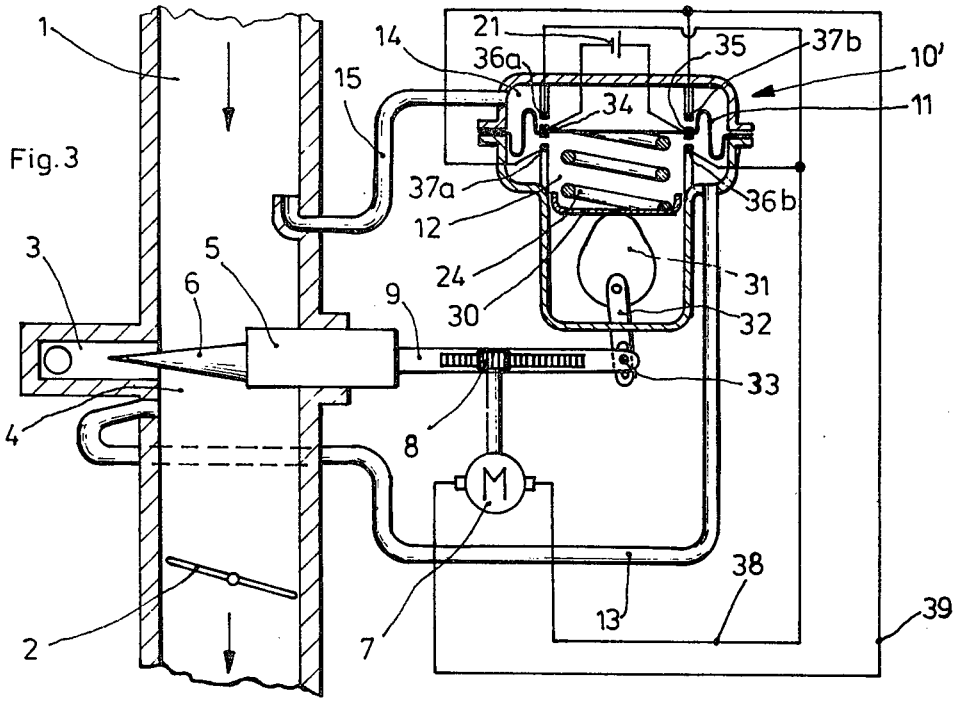
FIG. 3 is a partly sectional view of still another preferred embodiment of a carburetor in which feedback means variably link drive means to control means.

FIG. 3 shows another preferred embodiment, which, while similar to the embodiments described with reference to FIGS. 1 and 2, differs from those embodiments in the structure of the control means at 10'. The control means 10' have pressure chambers 12, 14 separated by a flexible diaphragm 11, but the contacts 34, 35 which move with the diaphragm are now connected to opposite sides of the power supply 21. The other contacts each have two poritons 36*a*, 36*b*, 37*a*, 37*b*, but are now fixedly mounted in the control means in spaced alignment with opposite sides of the contacts 34, 35 on the diaphragm to form between them the intermediate contactless portion or region at an undeflected position of the diaphragm.

When the throttle valve 2 closes to increase the pressure in the mixture region 4 relative to the pressure in the intake channel 1 upstream of the piston valve 5, the diaphragm is deflected into the pressure chamber 14 until the contacts 34, 35 engage the contact portions 36*a*, 37*b* to thereby connect the motor power supply lead 38 to the negative side of the supply 21 and, the lead 39 to the positive side; when the throttle valve opens to reduce the pressure in the mixture region relative to the pressure above the piston valve, the diaphragm is deflected into the pressure chamber 12 to connect the motor power supply lead 38 to the positive side of the power supply and, the lead 39 to the negative side. The relative polarity of the motor power supply leads 38, 39 operates the motor 7 in corresponding directions to move the piston valve 5 toward or away from the nozzle 3 as described with reference to FIGS. 1 and 2.

Feedback means in the embodiment shown in FIG. 3 comprise a cam 31 mounted in the control means for pivotable movement by a shaft 32 which extends from the cam to a pivotable connection 33 with the piston valve connecting rod 9. The cam 31 has a cam surface engaged with a movable bed plate 30 for the spring 24 in the pressure chamber 12. Movement of the piston by the piston rod 9 then pivots the cam 31 to move the spring bed plate 30 with the cam surface to variably urge the diaphragm 11 in one direction with the spring as a function of the position of the piston valve 5 which rotates the cam.

The cam surface is configured such that the movement of the piston valve rod 9 by the motor when the diaphragm has moved into the pressure chamber 14 to make motor lead 38 negative with respect to motor lead 39 lowers the bed plate 30 as seen in FIG. 3 and thereby reduces the spring pressure on the diaphragm to permit the diaphragm to return to the neutral position with the contacts 34, 35 at the intermediate contactless region of the other contacts to stop the motor. Opposite movement of the piston valve rod 9 causes the cam surface to raise the bed plate 30 to increase the spring force on the diaphragm and lift the diaphragm 11 from deflection into the pressure chamber 12. In contrast to the embodiment shown in FIG. 1, the diaphragm 11 in the embodiment shown in FIG. 3 is always undeflected when the motor 7 is not operating.

The cam surface is additionally configured to move the spring bed plate 30 more per unit of linear movement of the piston valve 5 at more right-hand positions of the piston valve, the directions being taken with respect to FIG. 3. The piston valve then restricts the intake channel more per unit volume of air flowing through the intake channel when the piston valve is in right-hand positions in the intake channel which, as before, correspond to engine operating conditions with more open positions of the throttle valve 2. The greater restriction of the intake channel by the piston valve in the more opened conditions of the throttle valve increases the speed of air flow past the nozzle 3 to draw more fuel from the nozzle per unit volume of the air for richening the fuel-to-air mixture.

The richening of the fuel mixture for more opened throttle conditions is thus a function of both the force of spring 24 and the cam surface. Proper configuration of the cam surface readily permits non-linear variation of the fuel-to-air mixture which is not readily achieved from the spring 24 (FIG. 1) alone because the force of generally available springs is well-known to be linear function of the displacement of the spring. The non-linear richening of the fuel-to-air mixture may be desirable for the operation of an internal combustion engine.

Figure 4:
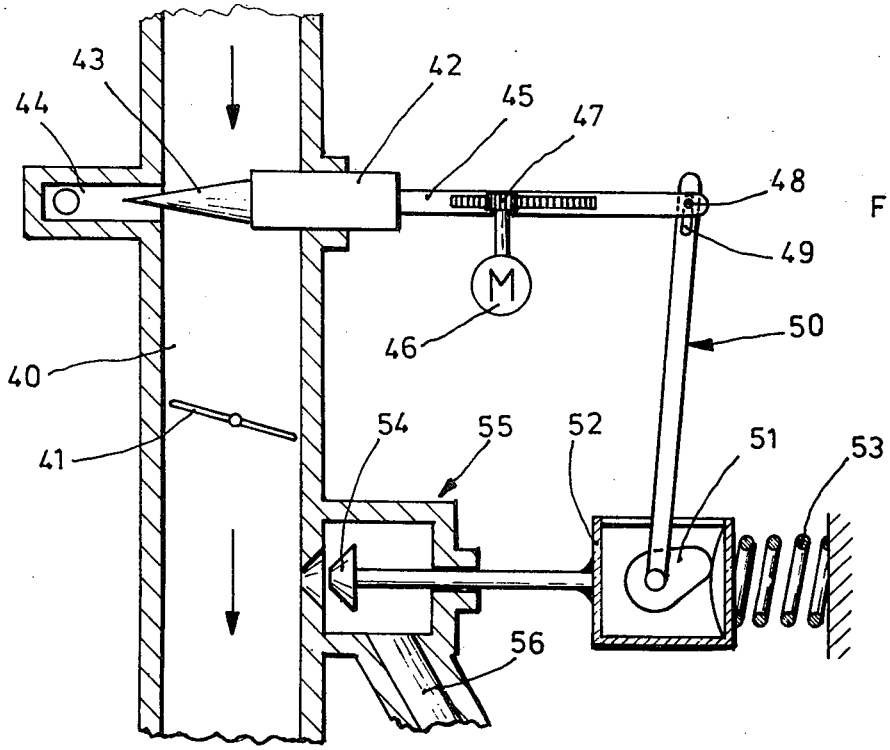
FIG. 4 is a partial view, partly in section, of still another preferred embodiment of a carburetor in which drive means operate multiple means in the carburetor.

FIG. 4 shows part of another preferred embodiment in which the motor movement of the piston valve 42 relative to the nozzle 44 also performs another function, the control of a valve 54 which seats in an opening through the intake channel downstream of the throttle valve 41. The valve seat opening communicates with an exhaust gas return channel 56 so that the position of the valve 54 relative to the seat opening controls the introduction of the exhaust gases into the fuel and air mixture supplied to the internal combustion engine.

The valve 54 has a stem extending from the exhaust return channel 56 to a housing 52. A cam 51 is rotatably mounted on the housing and connected to one end of a shaft at 50 for rotating the cam. The other end 49 of the shaft is connected by pivot 48 to the piston valve rod 45. Movement of the piston valve rod by the drive motor 46 through pinion 47 then rotates the cam 51. A cam surface of cam 51 engages a spring plate on an end of a spring 53 to resiliently position the housing 52 and connected valve 54 relative to the valve seat.

The configuration of the cam surface of cam 51 may be such as to seat the valve and close the opening for smaller openings of the throttle valve 41 and consequent more left-hand positions of the piston valve 42 and then increase the rate of opening of the valve 54 from its seat opening with more open positions of the throttle valve 41 and corresponding more right-hand positions of the piston valve 42. However, even with this increasing rate of exhaust gas introduction with increasingly open throttle positions, it may be desirable with certain internal combustion engines to cut off the introduction of exhaust gas at full throttle. An additional lobe (not shown) on the surface of the cam 51 may then reverse the opening of the valve 54 to rapidly close the valve as the throttle valve becomes fully opened.

It should be noted that the control means for the motor 46 are not shown in FIG. 4. The control means for FIG. 4 may include a cam additional to the cam 51, for example cam 31 (FIG. 3), or either of the control means shown in FIGS. 1 and 2.

The present invention has now been described with reference to particular preferred embodiments shown in the figures. It will be understood that these embodiments are susceptible to various changes, modifications, and adaptations as will occur to those skilled in the art. It is therefore intended that the scope of the present invention be limited only by the following claims.

I claim:

1. In a carburetor for an internal combustion engine comprising an intake channel for the passage of air, a throttle valve arranged in said intake channel, nozzle means having an exit aperture into said intake channel for discharging fuel into said intake channel upstream of said throttle valve, and a piston valve arranged to move linearly across said intake channel, upstream of said throttle valve, and in a direction substantially transverse to the longitudinal axis of said intake channel thereby to vary the cross-sectional area of said intake channel at the region of air-fuel mixture, said piston valve having a tapered nozzle needle projecting into said exit aperture of said fuel nozzle means; the improvement comprising servo motor drive means for positioning said piston valve in said intake channel, and means for controlling said drive means in dependence upon the difference between the total pressure in said intake channel and the static pressure in said mixture region of said intake channel.

2. A carburetor as in claim 1 wherein said means for controlling said drive means comprise first contact means, means moved in response to said pressure difference for moving said first contact means in a direction dependent upon said pressure difference, and other contact means engaged by said first contact means upon said movement of said first contact means and connected to said drive means for operating said drive means in a direction dependent upon the direction of said movement of said first contact means when engaged by said first contact means.

3. A carburetor as in claim 1 wherein said drive means additionally comprise feedback means cooperative with said means for controlling said drive means for determining when said drive means have moved said piston valve to a position determined by said means for controlling said drive means.

4. In a carburetor for an internal combustion engine comprising an intake channel for the passage of air, a throttle valve arranged in said intake channel, nozzle means having an exit aperture into said intake channel for discharging fuel into said intake channel upstream of said throttle valve, and a piston valve arranged to move linearly across said intake channel, upstream of said throttle valve, and in a direction substantially transverse to the longitudinal axis of said intake channel thereby to vary the cross-sectional area of the said intake channel at the point of air-fuel mixture, said piston valve having a tapered nozzle needle projecting into the exit aperture of said fuel nozzle means, the improvement comprising:

a drive motor for positioning said piston valve in said intake channel; means for controlling said drive motor comprising first contacts, means movable in a direction dependent upon an operating condition of said internal combustion engine for moving said first contacts, a power supply, other contacts each having first and second portions defining between them a contactless intermediate portion and engaged by said first contacts upon said movement of said first contacts for connecting said power supply to said drive motor to operate said drive motor in a direction dependent upon the direction of movement of said first contacts; and feedback means movable with said operation of said drive motor for relatively positioning said first contacts at said contactless intermediate portion of said other contacts whereby said motor is disconnected from said power supply.

5. A carburetor as in claim 4 wherein said feedback means is a rod extending from said piston valve for movement therewith and wherein said other contacts are mounted on said rod.

6. A carburetor as in claim 4 wherein said feedback means comprise a first rod extending from said piston valve for movement therewith, another rod pivotably connected at one end to said first rod and at the other end to a frame, and a third rod pivotably connected to said second rod intermediate said ends of said second rod and wherein said other contacts are mounted on said third rod.

7. A carburetor as in claim 4 wherein said means for controlling said drive motor additionally comprise means for urging said means for moving said first contacts in one of said directions and wherein said feedback means comprise means for varying the urging of said means as a function of the position of said piston valve.

8. A carburetor as in claim 7 wherein said means for urging said means for moving said first contacts comprise a spring having one end engaged with said means for moving said first contacts, and a movable spring bed plate engaged with the other end of said spring; and wherein said means for varying the urging of said means comprise a rod extending from said piston valve for movement therewith, a rotatable cam having a cam surface engaged with said bed plate for moving said bed plate with rotation of said cam, and means connecting said rod and said cam for rotating said cam with said movement of said rod.

9. A carburetor as in claim 4 additionally comprising means positionable for controlling the introduction of exhaust gases to said intake channel and means moved by said drive motor for positioning said means for controlling said exhaust gas introduction.

10. A carburetor as in claim 9 wherein said means for positioning said means for controlling said exhaust gas introduction comprise a cam and means for moving said cam with said drive motor.

* * * * *